United States Patent [19]

Governale

[11] 4,167,088

[45] Sep. 11, 1979

[54] DOORS FOR PATIOS AND THE LIKE

[75] Inventor: Bernard C. Governale, Duluth, Ga.

[73] Assignee: Peachtree Doors, Inc., Duluth, Ga.

[21] Appl. No.: 922,345

[22] Filed: Jul. 6, 1978

[51] Int. Cl.[2] ..... E06B 1/04

[52] U.S. Cl. ..... 52/207; 49/381; 49/501

[58] Field of Search ..... 49/501, 504, 381; 52/207, 291

[56] References Cited

U.S. PATENT DOCUMENTS

| | | | |
|---|---|---|---|
| 1,450,733 | 4/1923 | Reaugh | 49/504 |
| 3,378,290 | 4/1968 | Sekulich | 292/40 |
| 3,774,360 | 11/1973 | Hubbard et al. | 52/207 X |
| 3,950,894 | 4/1976 | DiMaio | 49/501 |
| 4,068,433 | 1/1978 | Glover | 52/207 |

*Primary Examiner*—Kenneth Downey
*Attorney, Agent, or Firm*—D. Paul Weaver

[57] ABSTRACT

An energy efficient, secure and economical patio door features hinged and fixed door panels with a strike mullion connected to the fixed door panel through a metal stiffener and with the strike mullion forming an integral part of the door frame by being tied thereto through head and sill members. The assembly is reversible end-to-end and therefore non-handed. The number of door panels can be increased or decreased and the assembly is fully weather-stripped.

3 Claims, 4 Drawing Figures

FIG. 1
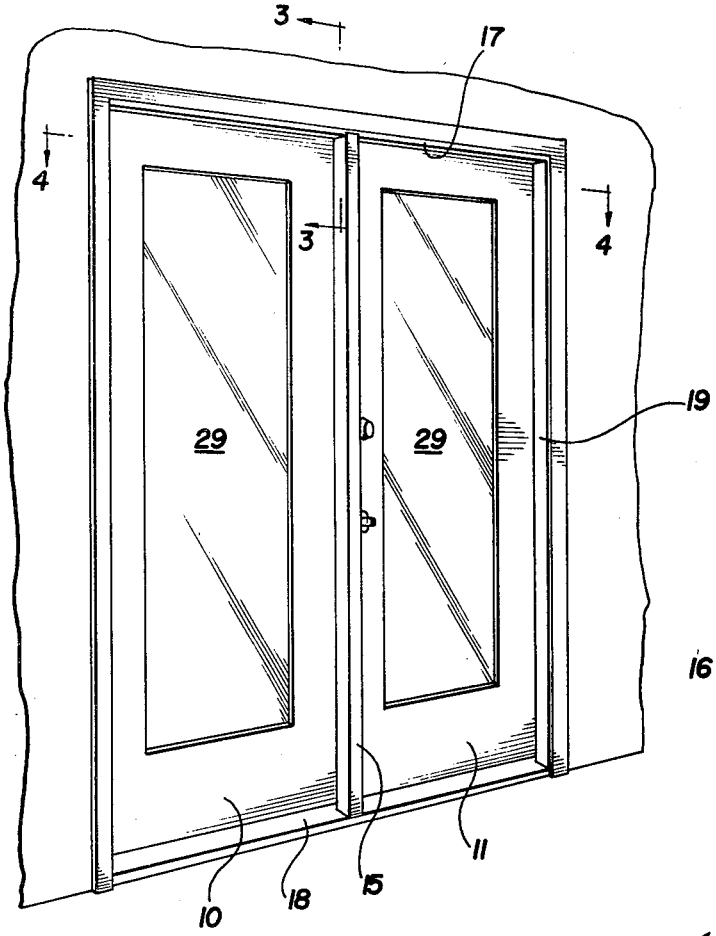
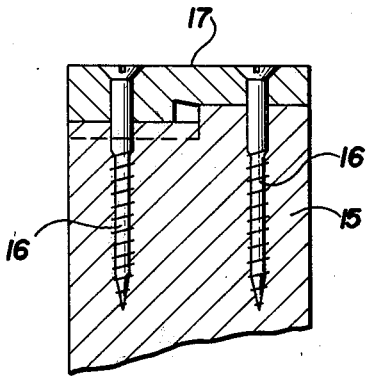
FIG. 3
FIG. 4
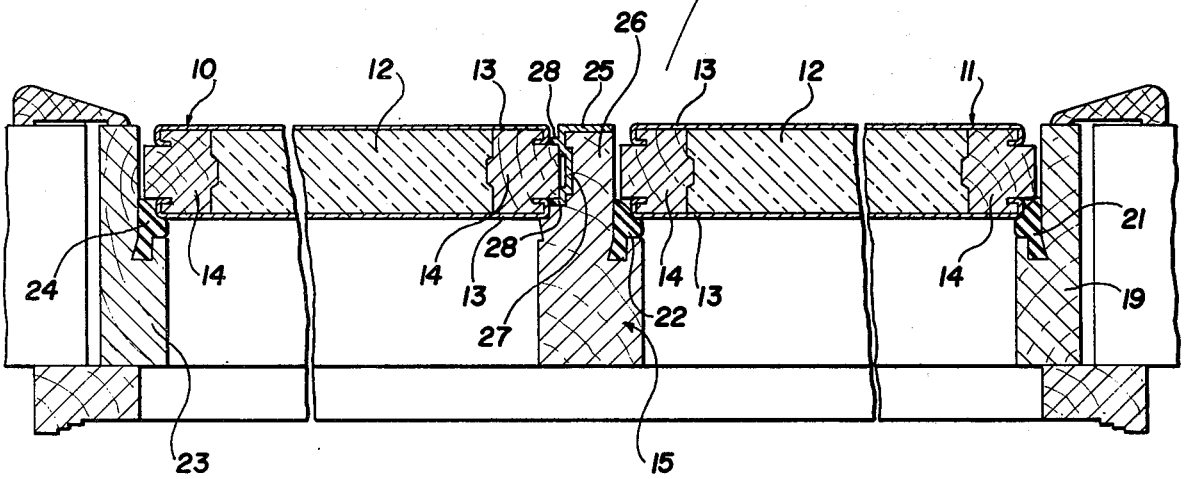

DOORS FOR PATIOS AND THE LIKE

BACKGROUND OF THE INVENTION

French doors and patio doors having fixed and hinged panels are known in the prior art, broadly speaking. Such prior art doors, while attractive, have tended to have certain deficiencies in terms of security or strength, thermal efficiency and cost on a comparative basis with other types of doors, such as sliding doors having aluminum frames. As a result, the latter type of door has been more widely used as a patio door with a distinct sacrifice in appearance and versatility.

In view of the above, the objective of the present invention is to provide an improved door system for patios and the like which completely overcomes the deficiencies of the prior art outlined above and allows the home owner or builder to utilize a much more architecturally attractive and versatile door system without sacrificing security, thermal efficiency and overall durability, and at a competitive cost with other door types. Other features of the invention will appear to those skilled in the art during the course of the following description.

To satisfy the requirements for disclosing known prior art under 37 C.F.R. 1.56, the following United States patents are made of record herein:

U.S. Pat. No. 533,801
U.S. Pat. No. 1,450,733
U.S. Pat. No. 2,281,864
U.S. Pat. No. 2,292,806
U.S. Pat. No. 2,611,933
U.S. Pat. No. 3,774,360
U.S. Pat. No. 4,031,665
U.S. Pat. No. 4,068,433

SUMMARY OF THE INVENTION

A fully insulated, fully weatherstripped, reversible patio door includes fixed and hinged door panels with an intervening strike mullion which is integrated in the door frame by being tied to continuous head and sill assemblies which span the plural door panels of the assembly. The fixed door panel is connected to the strike mullion through an aluminum stiffener member which locks the fixed door panel to the strike mullion thereby increasing the strength and rigidity of the entire assembly.

BRIEF DESCRIPTION OF THE DRAWINGS

FIG. 1 is a perspective view of a patio door embodying the invention.

FIG. 3 is an enlarged fragmentary vertical section taken on line 3—3 of FIG. 1.

FIG. 4 is an enlarged horizontal section taken on line 4—4 of FIG. 1.

DETAILED DESCRIPTION

Figure 2:
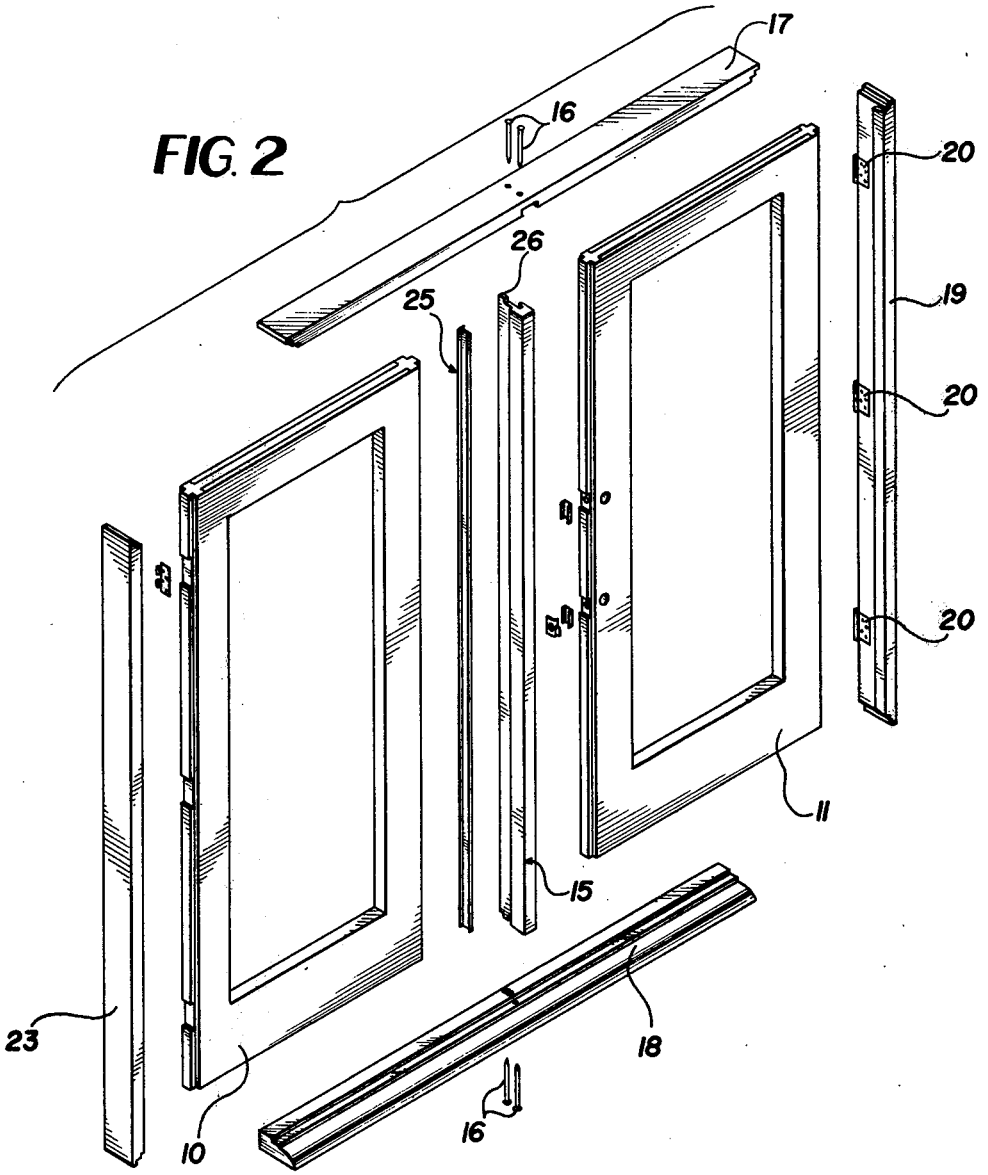
FIG. 2 is an exploded perspective view of the same.

Referring to the drawings in detail wherein like numerals designate like parts, a door for patios or the like comprises a fixed door panel 10 and an adjacent hinged panel 11 both of which are thermally insulated as indicated at 12 in FIG. 4. While FIG. 1 depicts a two panel patio door, it is to be understood that the invention is equally applicable to three and four panel systems which also include the main improvement features to be described and which have already been mentioned in the introductory part of the application.

Each door panel 10 and 11 has a pair of steel faces 13 securely locked into wooden stiles 14 and also locked into top and bottom wooden rails. The steel facings 13, stiles and rails are all bonded to the foamed-in-place polyurethane insulating core 12. The door panels thus formed are thermally efficient, strong and secure as well as having excellent appearance.

The door structure further comprises a wooden strike mullion 15 for the hinged door panel 11 and this mullion 15 extends from top-to-bottom of the assembly and is secured by long screws 16 at its top and bottom ends, respectively, to a horizontal head member 17 and sill assembly 18 which span the full width of the door. In this way, the strike mullion 15 becomes an integral part of the main door frame along with the elements 17 and 18 to materially strengthen the entire system.

A vertical hinge jamb 19 has the hinged door panel 11 connected therewith by hinges 20 which allow interior swinging of the panel 11, as indicated by the arrow in FIG. 4. As best shown in FIG. 4, the jamb 19 is equipped with a continuous vertical weatherstrip 21 which may be slid in and out of its seating groove in the jamb 19. Similarly, the strike mullion 15 has a continuous vertical weatherstrip 22, as shown. The far side of the assembly includes a vertical jamb 23 for the fixed door panel 10 rigidly connected therewith. The jamb 23 also possesses a continuous vertical weatherstrip 24 for sealing the adjacent fixed panel 10.

A very important part of the invention comprises an aluminum stiffener 25 for the mullion 15 which is firmly secured thereto by suitable screws, not shown. The stiffener extends for the full height of the mullion 15 and serves to rigidly join the mullion 15 to the adjacent stile 14 of fixed door panel 10. In this manner, the mullion 15 and the fixed panel 10 are locked together as a unit, rendering the entire door structure more rigid and more secure. As best shown in FIG. 4, the continuous vertical stiffener 25 is generally L-shaped in cross section so as to lap two right angular faces of the mullion extension 26. The stiffener has an inset web 27 which engages lockingly in a recess of the mullion, and additionally has spaced parallel vertical flanges 28 which lockingly engage with the stile 14 of fixed door panel 10.

The hinged panel 11 is equipped with conventional latch means and trim hardware, the nature of which may be varied in different cases. The door structure is reversible end-for-end making it non-handed.

By means of the invention, a very secure, weathertight and thermally efficient door is provided which may possess a traditional European look or "Old World" appearance at a competitive cost with much less attractive commonly used sliding patio doors. An optional grill, not shown in the drawings, can convert the large door panes 29 into a plurality of small rectangular colonial or diamond panes to meet customizing requirements. A very high quality patio door is achieved without great cost and the construction is versatile and highly attractive. Its advantages over the known prior art should be readily apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A door structure for patios and the like comprising at least one fixed and one hinged door panel in side-by-side relationship in a common vertical plane, a center mullion extending from top to bottom of said door panels and having a portion thereof projecting between said fixed and hinged door panels, a hinge jamb for said hinged door panel extending from top to bottom thereof, said center mullion constituting a strike member for said hinged door panel, a jamb for the edge of the fixed door panel away from said center mullion, and a metal stiffener for said center mullion extending from top to bottom thereof and being connected with the center mullion and with a stile of said fixed door panel and locking the fixed door panel rigidly to the center mullion, said metal stiffener comprising a unitary member of uniform cross section and being generally L-shaped in cross section and lapping to substantially right angular faces on the portion of the center mullion projecting between said fixed and hinged door panels, projecting flanges on said stiffener extending from top to bottom thereof at one side of the center mullion and being lockingly engaged with the adjacent stile of the fixed door panel, and said stiffener additionally having an inset web between said flanges engaged lockingly in a recess provided in said portion of said center mullion projecting between said fixed and hinged door panels, said web and recess extending from top to bottom of the center mullion, and said portion of the center mullion being of reduced thickness compared to the body portion of the mullion lying forwardly of the fixed and hinged door panels.

2. A door structure for patios and the like as defined in claim 1, and weather strips for said fixed and hinged door panels extending from top to bottom thereof on said center mullion and on said jambs.

3. A door structure for patios and the like as defined in claim 1, and a horizontal head member and sill at the top and bottom of the door structure completely spanning said fixed and hinged door panels between said hinge jamb and jamb for the fixed door panel, and means directly connecting said head member and sill to the top and bottom ends of said center mullion.

* * * * *